US007044203B2

(12) United States Patent
Yagi et al.

(10) Patent No.: US 7,044,203 B2
(45) Date of Patent: May 16, 2006

(54) STRUCTURE CONNECTING HEAT EXCHANGER TO SHROUD IMPROVING WORKABILITY IN ASSEMBLING OR DISASSEMBLING THEM

(75) Inventors: Yoshinori Yagi, Kariya (JP); Tatsuo Ozaki, Kariya (JP)

(73) Assignee: DENSO Corporation, Kariya (JP)

( * ) Notice: Subject to any disclaimer, the term of this patent is extended or adjusted under 35 U.S.C. 154(b) by 280 days.

(21) Appl. No.: 10/666,056

(22) Filed: Sep. 17, 2003

(65) Prior Publication Data

US 2004/0069442 A1 Apr. 15, 2004

(30) Foreign Application Priority Data

Sep. 19, 2002 (JP) ..... 2002-272715

(51) Int. Cl.
*F28F 13/12* (2006.01)

(52) U.S. Cl. ..... 165/122; 165/67

(58) Field of Classification Search ..... 165/67, 165/122, 140; 180/68.4
See application file for complete search history.

(56) References Cited

U.S. PATENT DOCUMENTS

| | | | | |
|---|---|---|---|---|
| 3,980,132 | A * | 9/1976 | Mitchell et al. | 165/76 |
| 5,219,016 | A * | 6/1993 | Bolton et al. | 165/67 |
| 5,269,367 | A * | 12/1993 | Susa et al. | 165/41 |
| 5,657,817 | A * | 8/1997 | Heine et al. | 165/67 |
| 5,996,684 | A * | 12/1999 | Clifton et al. | 165/67 |
| 6,237,676 | B1 * | 5/2001 | Hasegawa et al. | 165/67 |
| 6,273,182 | B1 * | 8/2001 | Pautler et al. | 165/67 |
| 6,315,034 | B1 * | 11/2001 | Mahe et al. | 165/121 |
| 6,318,450 | B1 * | 11/2001 | Acre | 165/67 |
| 6,510,891 | B1 * | 1/2003 | Anderson et al. | 165/67 |
| 6,682,319 | B1 * | 1/2004 | Kobayashi | 165/122 |

FOREIGN PATENT DOCUMENTS

| | | | |
|---|---|---|---|
| DE | 42 44 037 | | 6/1994 |
| EP | 1 221 556 | | 8/2003 |
| FR | 2 713 754 | | 6/1995 |
| JP | 3-57815 | * | 3/1991 |
| JP | 11-142084 | | 5/1999 |
| JP | 3061037 | | 6/1999 |
| JP | 2002-168588 | | 6/2002 |

OTHER PUBLICATIONS

Patent Abstracts of Japan, Publication No. 07251639 dated Oct. 3, 1995.
Patent Abstracts of Japan, Publication No. 07293245 dated Nov. 7, 1995.
Patent Abstracts of Japan, Publication No. 60119321 dated Jun. 26, 1985.

* cited by examiner

*Primary Examiner*—Teresa J. Walberg
(74) *Attorney, Agent, or Firm*—Harness, Dickey & Pierce, PLC

(57) ABSTRACT

A fan shroud 4 is assembled to a cooling module in such a way that the fan shroud 4 covers brackets 3 that have been assembled to the cooling module, that is, a radiator 1 and a condenser 2 and, at the same time, snap fits 3*h* and a vehicle body prevent the fan shroud 4 from being detached from the brackets 3. In this way, it is possible to easily assemble the cooling module and the fan shroud 4 and, therefore, it is also possible to improve the workability in assembling or disassembling the cooling module and the fan shroud 4.

18 Claims, 15 Drawing Sheets

B PORTION ENLARGEMENT

STRUCTURE CONNECTING HEAT EXCHANGER TO SHROUD IMPROVING WORKABILITY IN ASSEMBLING OR DISASSEMBLING THEM

BACKGROUND OF THE INVENTION

1. Field of the Invention

The present invention relates to a structure connecting a shroud to a heat exchanger in order to fix an air blower to the heat exchanger, and is effective when applied to a vehicle.

2. Description of the Related Art

Conventionally, after a radiator and a shroud were fixed to a vehicle-mounting bracket, a module into which the radiator and the shroud (including an air blower) had been integrated was assembled to a vehicle (for example, refer to Patent Reference 1.)

[Patent Reference 1]

Japanese Unexamined Patent Publication (Kokai) No. 11-142084

According to the invention described in Patent Reference 1, however, it is necessary to fix a shroud to a bracket after fixing the bracket to a radiator, and this does not necessarily provide good workability in assembly and disassembly.

SUMMARY OF THE INVENTION

The present invention has been developed with the above-mentioned problems being taken into consideration, and the first object thereof is to provide a structure connecting a shroud to a heat exchanger, which is novel and different from the prior art. The second object is to improve the workability while assembling or disassembling a heat exchanger and a shroud.

To realize the above-mentioned objects, according to a first aspect of the present invention, a structure for assembling a heat exchanger (1) and a shroud (4) comprises: an air blower (5) that sends a current of air to the heat exchanger (1); the shroud (4) that guides the current of air sent from the air blower (5) to the heat exchanger (1); and brackets (3) for mounting the heat exchanger (1) to a vehicle body; wherein the brackets (3) and the shroud (4) are pressed by part of the vehicle body and prevented from moving in the vertical direction in a state in which the horizontal movement of the shroud (4) with respect to the brackets (3) is prevented by projections (3*b*) that are formed on the top end sides of the brackets (3) and project upward, and the bottom end side of the shroud (4) is supported by support projections (3*j*) provided to the bracket (3).

In this way, it is possible to easily assemble the heat exchanger (1) and the shroud (4) because the shroud (4) is assembled to the heat exchanger (1) in such a way that the shroud (4) covers the brackets (3) that have been assembled to the heat exchanger (1) and, at the same time, the shroud (4) is prevented from being detached from the brackets (3) by the vehicle body.

Therefore, it is possible to improve the workability in assembling or disassembling the heat exchanger (1) and the shroud (4).

According to a second aspect of the present invention, a structure connecting a shroud (4) to a heat exchanger (1) comprises: an air blower (5) that sends a current of air to the heat exchanger (1); and the shroud (4) that guides the current of air sent from the air blower (5) to the heat exchanger (1); wherein the heat exchanger (1) and the shroud (4) are pressed by part of a vehicle body and prevented from moving in the vertical direction in a state in which the horizontal movement of the shroud (4) with respect to the heat exchanger (1) is prevented by projections (3*b*) that are formed on the top end side of the heat exchanger (1) and project in a vertical direction, and the bottom end side of the shroud (4) is supported by support projections (3*j*) provided to the heat exchanger (1).

In this way, it is possible to easily assemble the heat exchanger (1) and the shroud (4) because the shroud (4) is assembled to the heat exchanger (1) in such a way that the shroud (4) covers the heat exchanger (1) and, at the same time, the shroud (4) is prevented from being detached from the brackets (3) by the vehicle body.

Therefore, it is possible to improve the workability in assembling or disassembling the heat exchanger (1) and the shroud (4).

According to a third aspect of the present invention, a structure connecting a shroud (4) to a heat exchanger (1) comprises: an air blower (5) that sends a current of air to the heat exchanger (1); the shroud (4) that guides the current of air sent from the air blower (5) to the heat exchanger (1); and brackets (3) for mounting the heat exchanger (1) to a vehicle body; wherein the brackets (3) and the shroud (4) are prevented from moving in the vertical direction by tightening-coupling means (3*h*) provided at least to either of the brackets (3) or the shroud (4) in a state in which the horizontal movement of the shroud (4) with respect to the brackets (3) is prevented by projections (3*b*) that are formed on the top end sides of the brackets (3) and project upward, and the bottom end side of the shroud (4) is supported by support projections (3*j*) provided to the brackets (3).

In this way, it is possible to easily assemble the heat exchanger (1) and the shroud (4) because the shroud (4) is assembled to the heat exchanger (1) in such a way that the shroud (4) covers the brackets (3) that have been assembled to the heat exchanger (1) and, at the same time, the shroud (4) is prevented from being detached from the brackets (3), by the tightening-coupling means (3*h*).

Therefore, it is possible to improve the workability in assembling or disassembling the heat exchanger (1) and the shroud (4).

According to a fourth aspect of the present invention, a structure connecting a shroud (4) to comprises: an air blower (5) that sends a current of air to the heat exchanger (1); and the shroud (4) that guides the current of air sent from the air blower (5) to the heat exchanger (1); wherein the heat exchanger (1) and the shroud (4) are pressed by tightening-coupling means (3*h*) provided to the heat exchanger (1) and are prevented from moving in the vertical direction in a state in which the horizontal movement of the shroud (4) with respect to the heat-exchanger (1) is prevented by projections (3*b*) that are formed on the top end side of the heat exchanger (1) and project in a vertical direction, and the bottom end side of the shroud (4) is supported by support projections (3*j*) provided to the heat exchanger (1).

In this way, it is possible to easily assemble the heat exchanger (1) and the shroud (4) because the shroud (4) is assembled to the heat exchanger (1) in such a way that the shroud (4) covers the heat exchanger (1) and, at the same time, the shroud (4) is prevented from being detached from the brackets (3) by the tightening-coupling means (3*h*).

Therefore, it is possible to improve the workability in assembling or disassembling the heat exchanger (1) and the shroud (4).

In a fifth aspect of the present invention, the tightening-coupling means (3*h*) have at least an engaging-stopping projection that can displace elastically.

In a sixth aspect of the present invention, the brackets (3) are provided with projections (3*b*) and the shroud (4) is provided with insertion holes (4*a*) into which the projections (3*b*) are inserted.

In a seventh aspect of the present invention, plural heat exchangers (1, 2) are assembled to the brackets (3) so as to sandwich the brackets.

In an eighth aspect of the present invention, the shroud (4) has a substantially L-shaped section which comprises: a top end portion that is assembled to a projections of the brackets (3) (or the heat exchanger (1)); and an air guide portion that supports the air blower (5) and guides the current of air that has passed through the heat exchanger to the air blower (5).

The symbols within the brackets that follow each components described above are an example of the correspondence with concrete components that will be described later in the description of the preferred embodiments.

The present invention may be more fully understood from the description of the preferred embodiments of the invention set forth below, together with the accompanying drawings.

DESCRIPTION OF THE PREFERRED EMBODIMENTS (First Embodiment)

In the present embodiment, the structure connecting a shroud to a heat exchanger according to the present invention is applied to a structure for assembling a cooling module into which an on-board radiator and an outdoor heat exchanger, which is located outside an air-conditioned compartment, of an on-board air conditioning system have been integrated.

Figure 1:
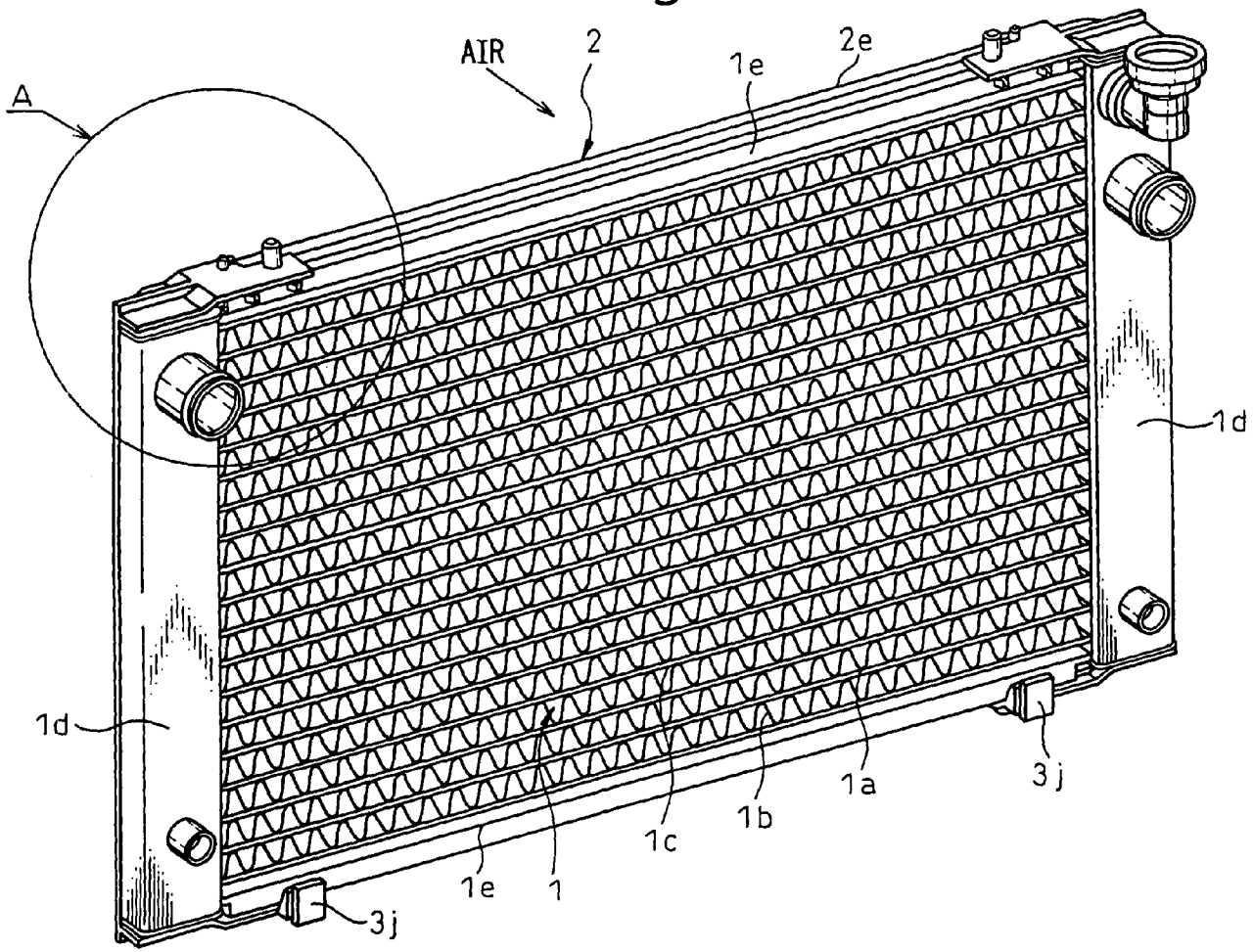
FIG. 1 is a perspective view of a cooling module according to a first embodiment of the present invention.
Figure 2:
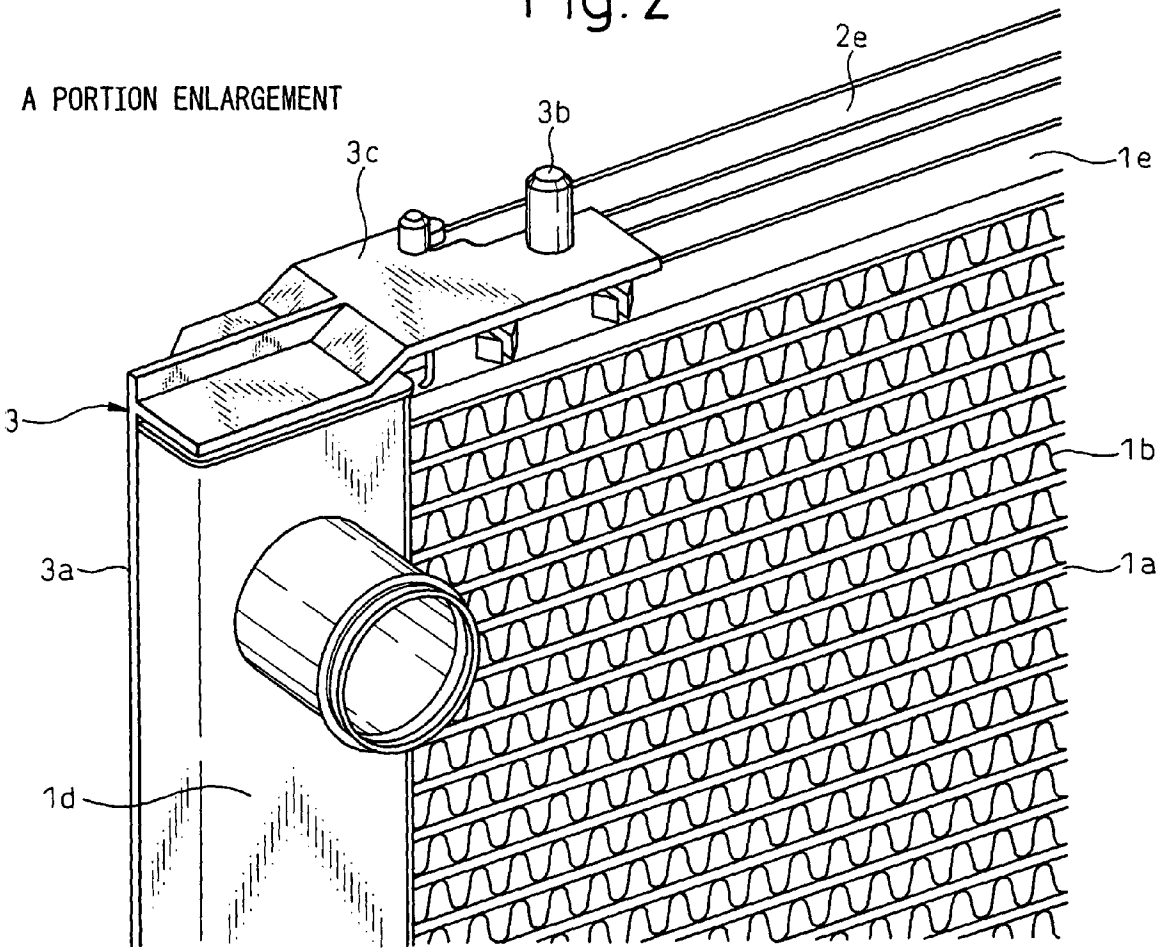
FIG. 2 is an enlarged view of part A in FIG.1

FIG. 1 is a perspective view of a cooling module viewed from the downstream side of a current of air, and FIG. 2 is an enlarged view of part A shown in FIG. 1.

A radiator 1 cools cooling water that circulates through an engine by exchanging heat between the cooling water and the air, and a condenser 2 (refer to FIG. 1) cools and condenses a high-pressure refrigerant discharged from a compressor.

The radiator 1 and the condenser 2 have a substantially identical structure, in concrete terms, comprising: a core section 1c comprising a plurality of tubes 1*a*, through which fluid, i.e., cooling water in the case of the radiator 1 and refrigerant in the case of the condenser 2, etc. flows and fins 1*b* that are joined to the outer surfaces of the tubes and increase the heat transferring area through which heat is transferred to the outside air; header tanks 1*d* that are communicated with the plurality of tubes 1*a* at both ends in the direction of the length of the tubes 1*a* and that extend in the direction substantially perpendicular to the direction of the length of the tubes 1*a*; inserts 1*e* that are located at the ends of the core section 1*c*, extend in the direction parallel to the direction of the length of the tubes 1*a*, and reinforce the core section 1*c*; and so on, as shown in FIG. 1; and in the present embodiment, all of these components are made of aluminum alloy and are integrated into one unit by brazing.

Because the core section of the condenser 2 is not shown in FIG. 1, the symbols of the tubes, fins, a core section, header tanks and inserts are only those relating to the radiator 1.

"Brazing" is a technique to join two pieces of metal by using a brazing filler metal or solder without melting a base metal, according to, for example, "Bonding and Joining Technique", published by Tokyo Denki University Press. In general, joining work which is done by using a filler metal whose melting point is above 450° C. is called brazing, and the filler metal is called a brazing filler metal, and when a filler metal whose melting point is below 450° C. is used for joining, it is called soldering and the filler metal is called a solder.

The radiator 1 and the condenser 2 are arranged in such a way that core sections 1*c* thereof are parallel, i.e. one of the core surface of the radiator 1 is opposed to that of the condenser 2, and there is a fixed gap between the respective core sections 1*c*, and, at the same time, they are fixed to brackets 3 that are arranged so as to be sandwiched between the radiator 1 and the condenser 2 as shown in FIG. 2, and they are attached to a vehicle body via the brackets 3.

Figure 3:
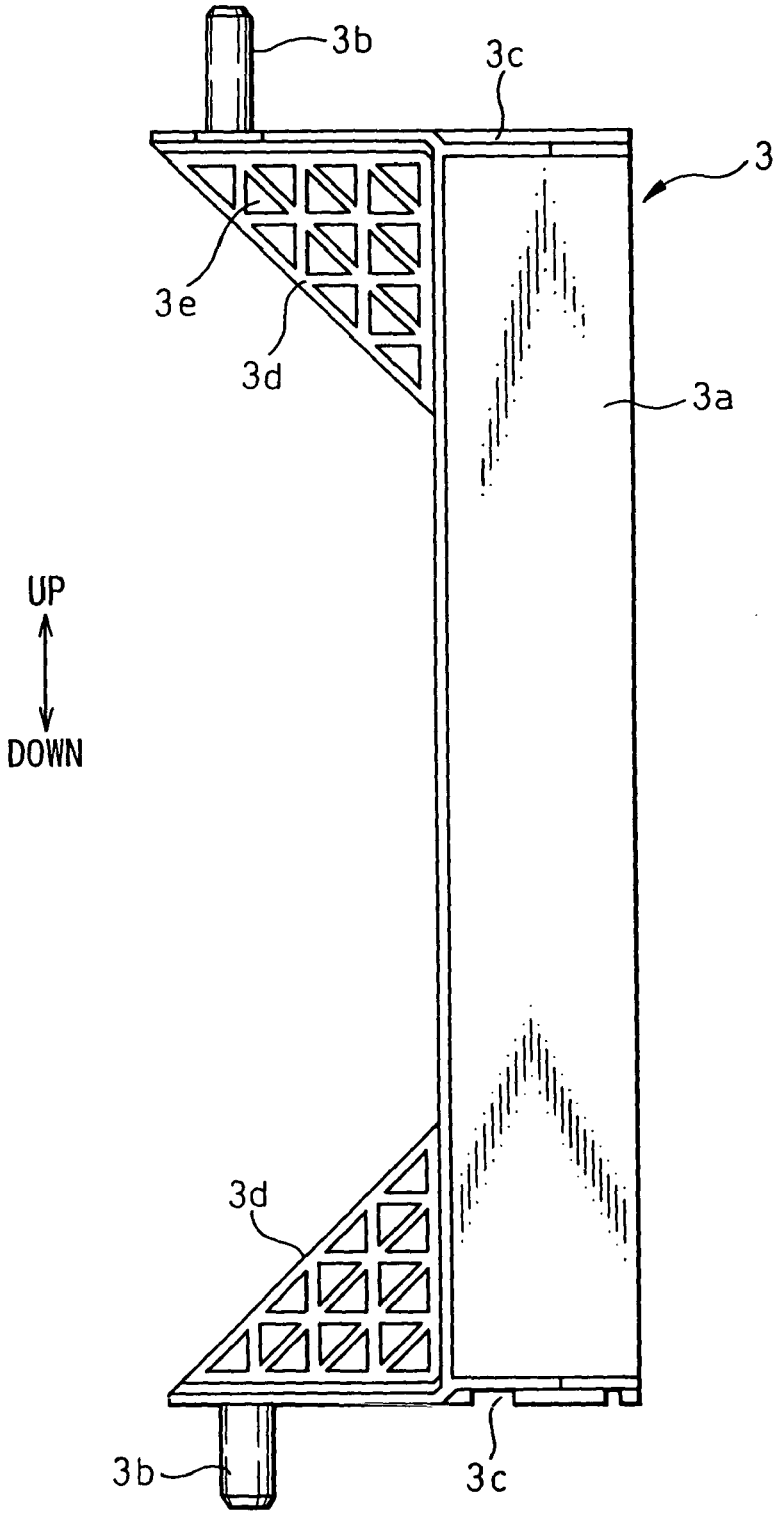
FIG. 3 is a front view of a bracket according to an embodiment of the present invention.

The bracket 3 comprises a bracket main body 3*a*, mounting pins 3*b*, mounting stays 3*c*, reinforcing parts 3*d*, and so on, as shown in FIG. 3, and these components 3*a* to 3*d* are integrally formed into one unit by using a resin (for example, nylon containing glass fiber).

The bracket main body 3*a* is a thin rectangular and extends in the vertical direction at the portions corresponding to the header tank 1*d* of the radiator 1 and the header tank of the condenser 2, that is, the positions corresponding to the ends of the radiator 1 and the condenser 2, and the mounting stays 3*c* are thin rectangular plate shape are provided at the top and bottom ends of the bracket main body 3*a*, and project toward the core sections of the radiator 1 and the condenser 2 from the bracket main body 3*a*.

The mounting stays 3*c* are provided with the mounting pins 3*b* for assembling the cooling module, that is, the radiator 1 and the condenser 2 integrated into one unit by the brackets 3, to the vehicle body, and the mounting pins 3*b* are pin-shaped projections that project upward and downward from the mounting stays 3*c*. The reinforcing part 3*d* has a substantially triangular shape and is attached to the base side of the mounting stay 3*c* to support the moment produced at the junction of the mounting stay 3*c* and the bracket main body 3*a*, and a plurality of holes 3*e* are provided in the reinforcing part 3*d* in such a way that the hole penetrates through the reinforcing part 3*d* in the direction perpendicular to the core surface, that is, in the direction in which air should flow.

In the present embodiment, by forming the holes 3*e* into a substantially triangular shape, the reinforcing part 3*d* has a truss structure and the strength thereof is prevented from being considerably reduced.

Figure 5:
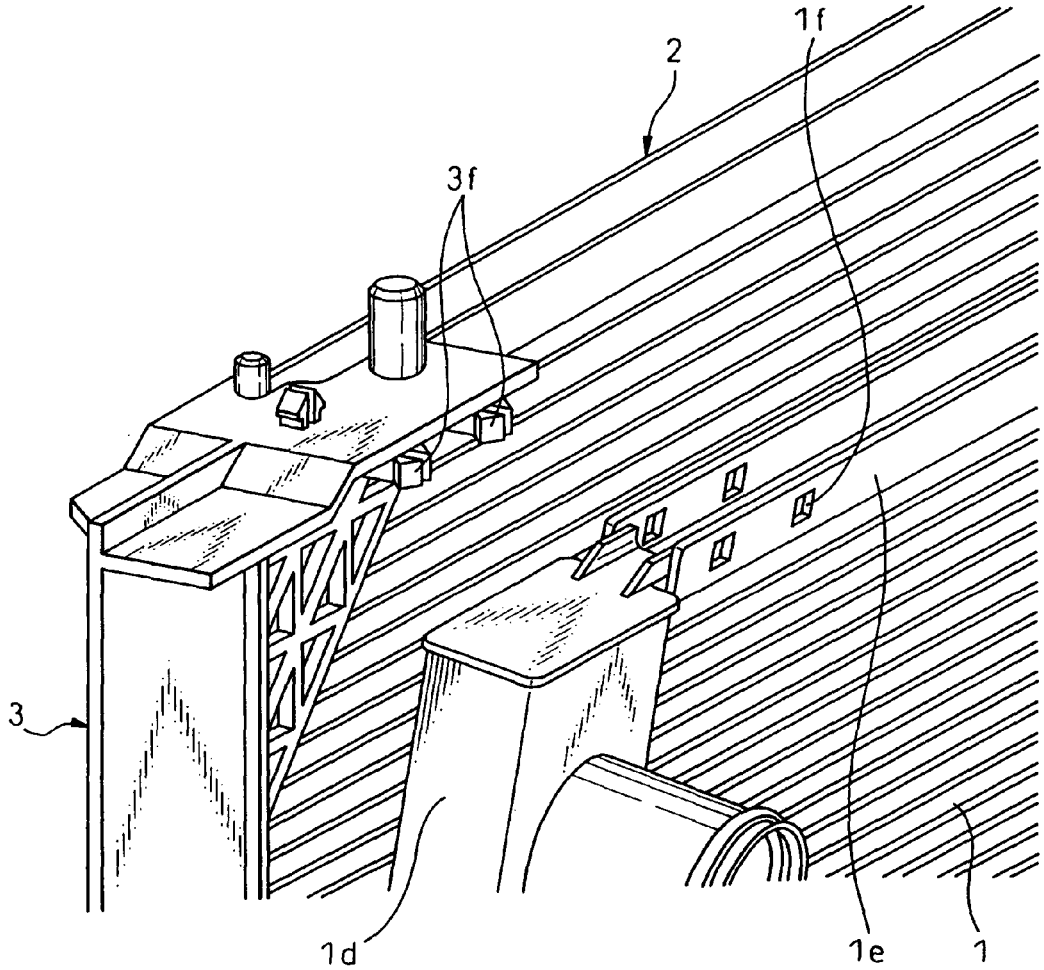
FIG. 5 is an explanatory view of the assembly of the cooling module according to the first embodiment of the present invention.
Figure 6:
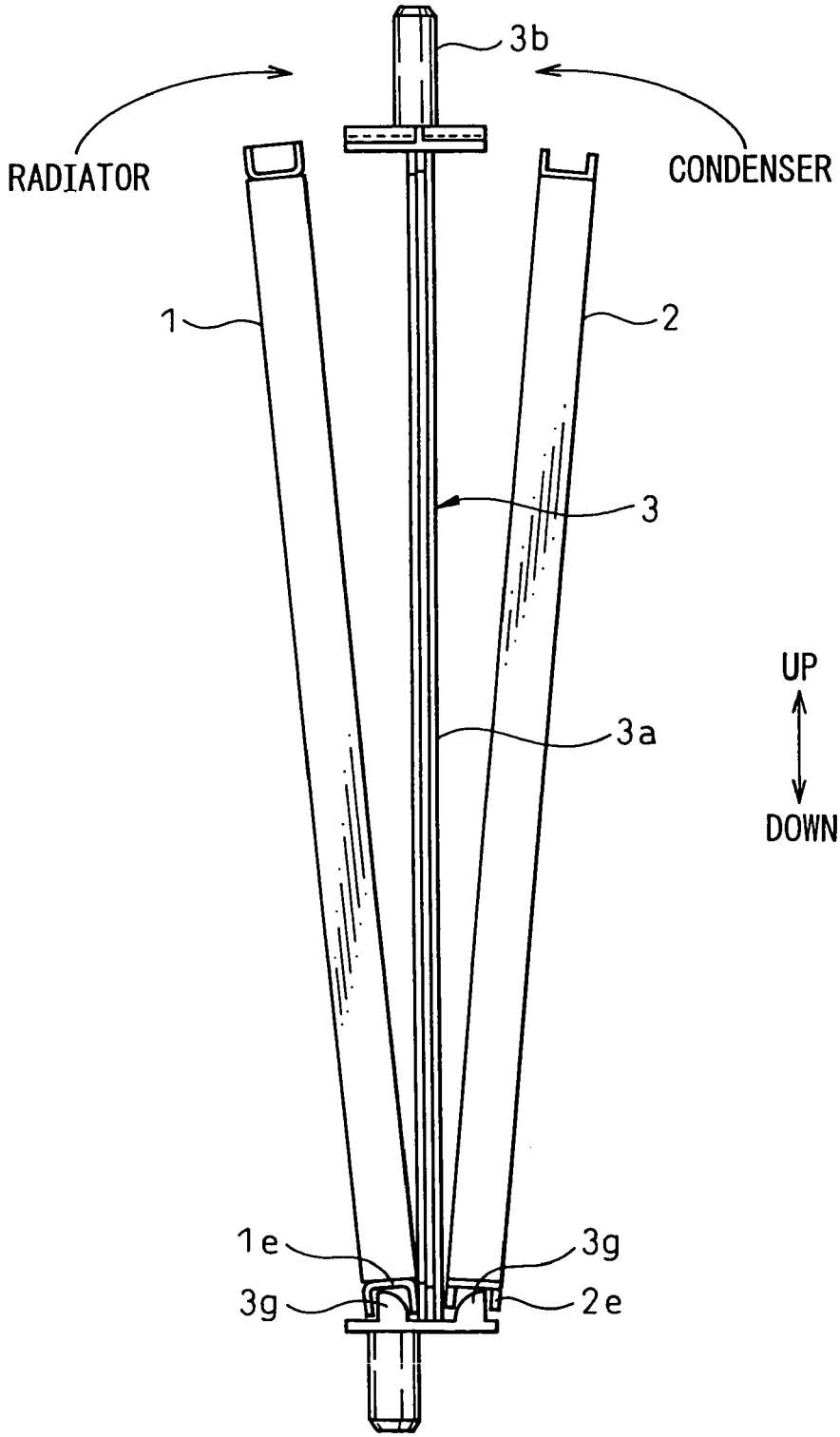
FIG. 6 is an explanatory view of the assembly of the cooling module according to the first embodiment of the present invention.

As shown in FIG. 5, the top end side of the radiator 1 is fixed to the brackets 3 by inserting snap fits 3*f* provided to the brackets 3 into holes 1*f* provided in the insert 1*e*, and the bottom end side thereof is fixed to the brackets 3 by inserting projections 3*g* formed on the bottom end sides of the brackets 3 into a recess, which is formed by making the section of the insert 1*e* into a substantially reversed-C shape, as shown in FIG. 6.

The snap fit 3*f* is a tightening-coupling means for detachably tightening, coupling, and fixing two members by utilizing the elastic deformation of projections formed into a hook-shape and, in the present embodiment, the snap fits 3*f* are integrally formed with the bracket 3.

Figure 4:
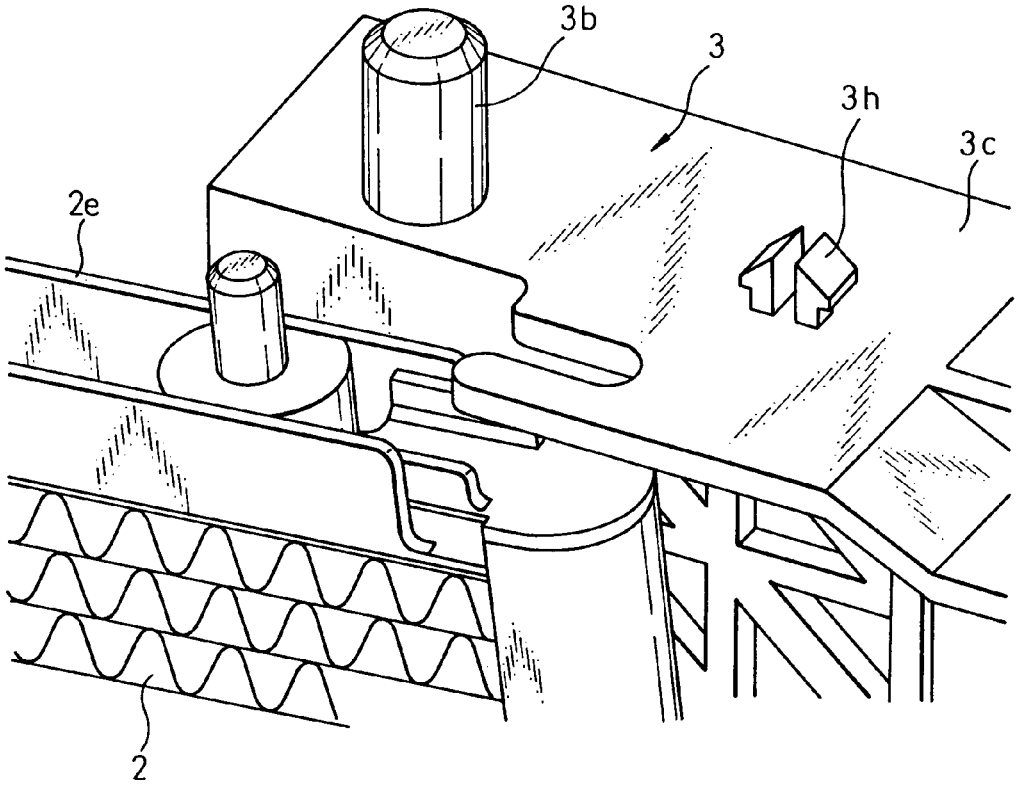
FIG. 4 is an explanatory view of the assembly of the cooling module according to the first embodiment of the present invention.

The top end side of the condenser 2 is fixed to the brackets 3 by inserting parts of the brackets 3 into the insert 2*e*, as shown in FIG. 4, and the bottom end side thereof is fixed to the brackets 3 by inserting the projections 3*g* into the recess of the insert 2*e*, as similar to the radiator 1 (refer to FIG. 6).

Figure 7:
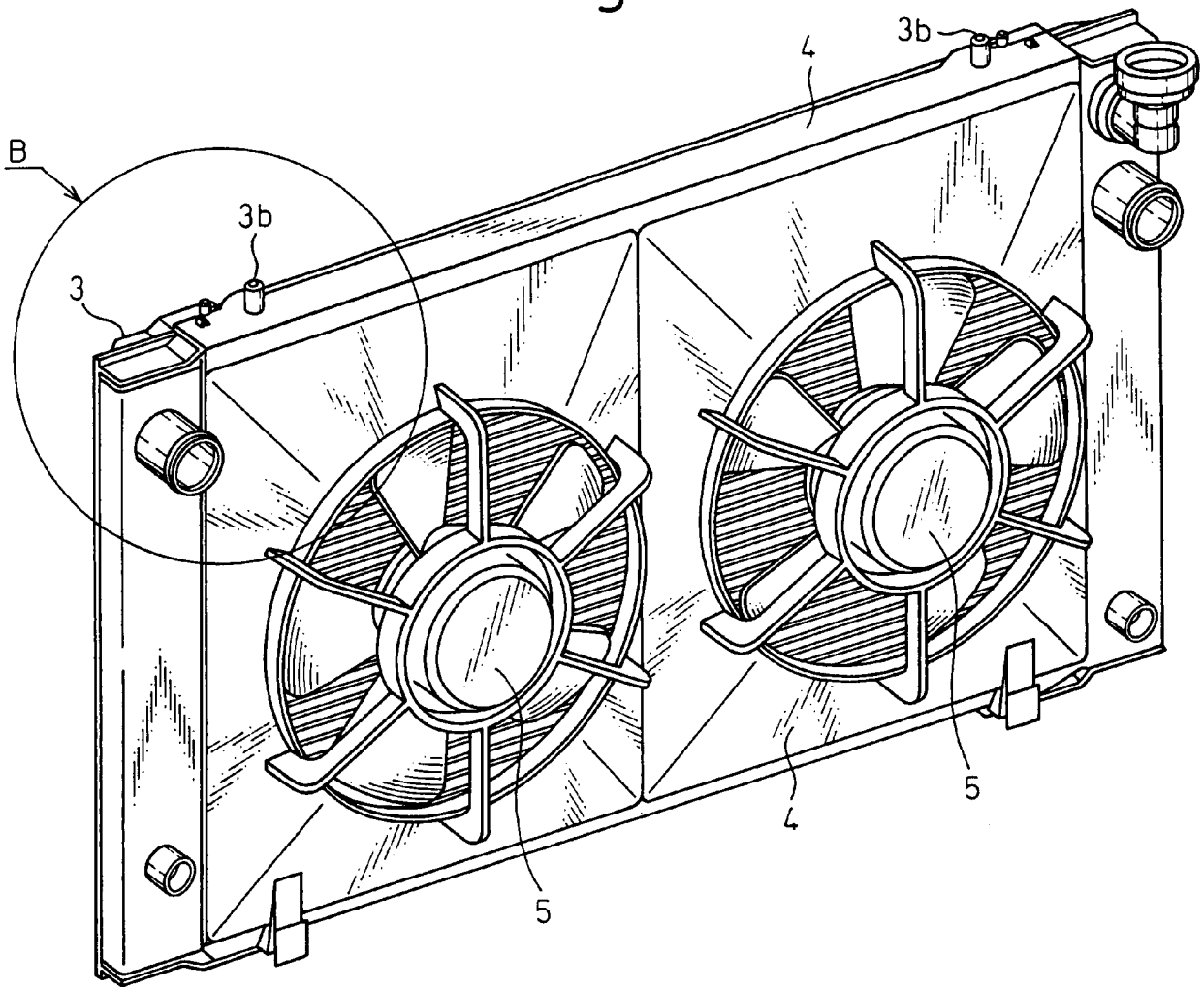
FIG. 7 is an explanatory view of the assembly of the cooling module according to the first embodiment of the present invention.
Figure 8:
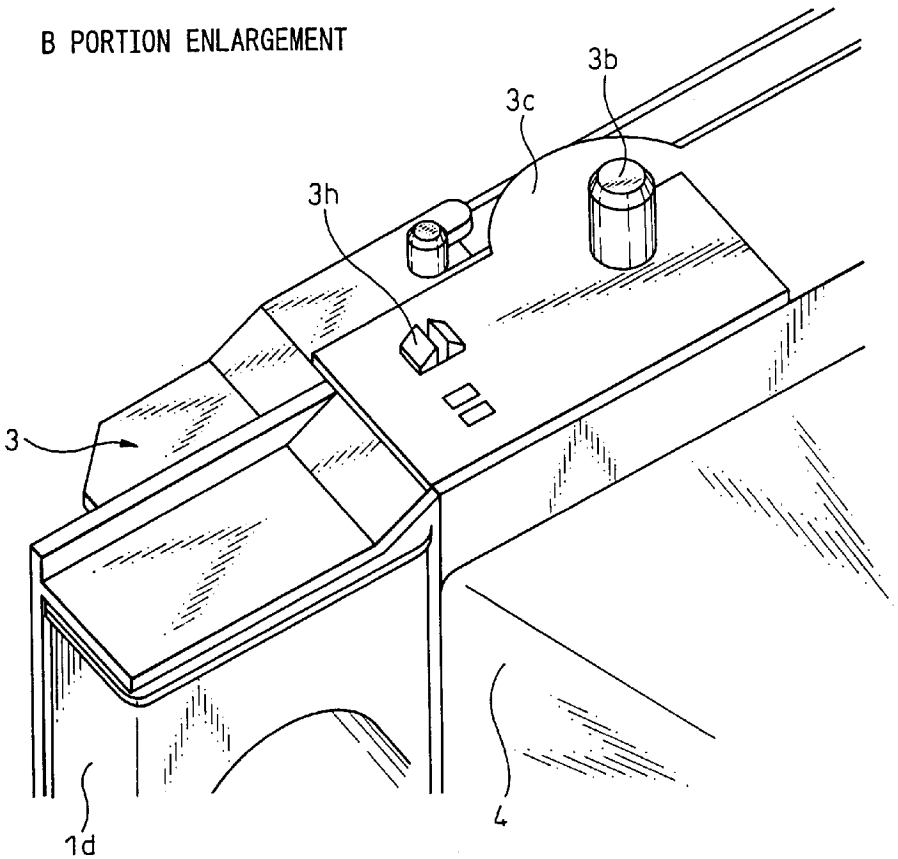
FIG. 8 is an explanatory view of the assembly of the cooling module according to the first embodiment of the present invention.
Figure 10:
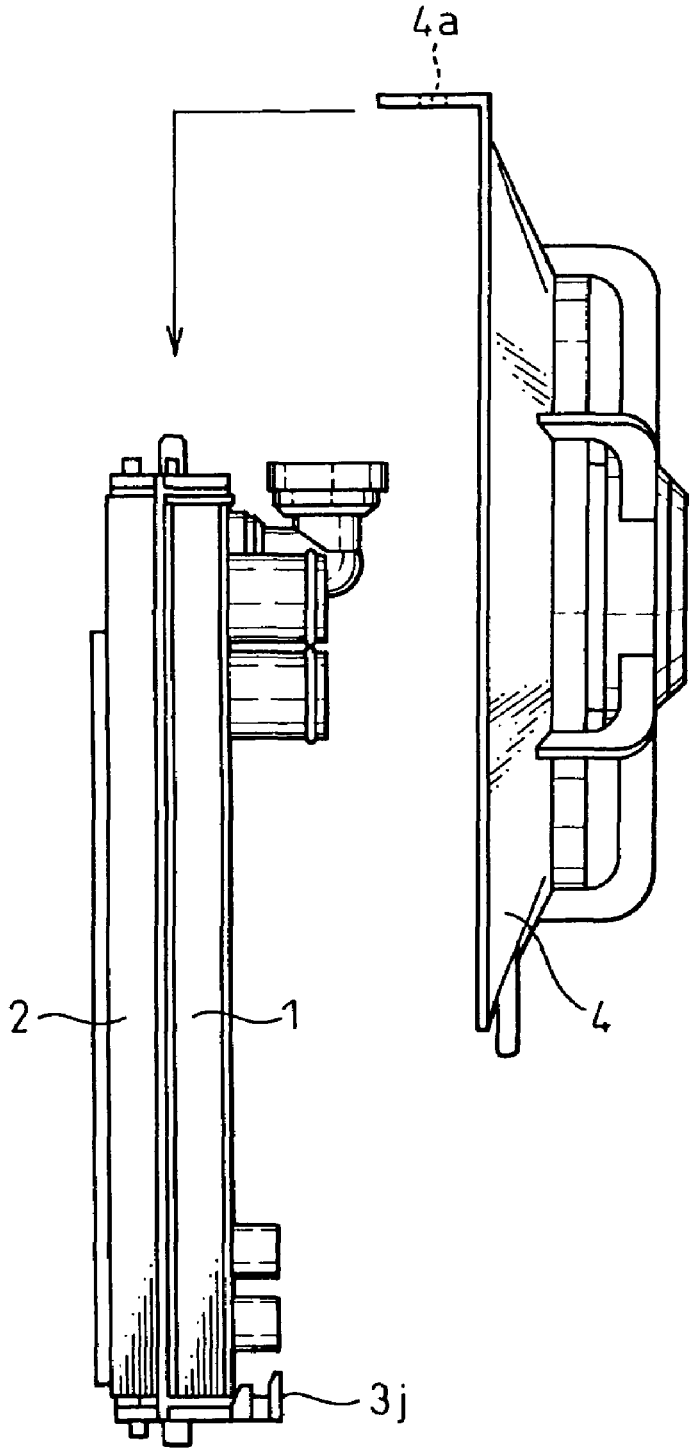
FIG. 10 is an explanatory view of the assembly of the cooling module according to the first embodiment of the present invention.
Figure 11:
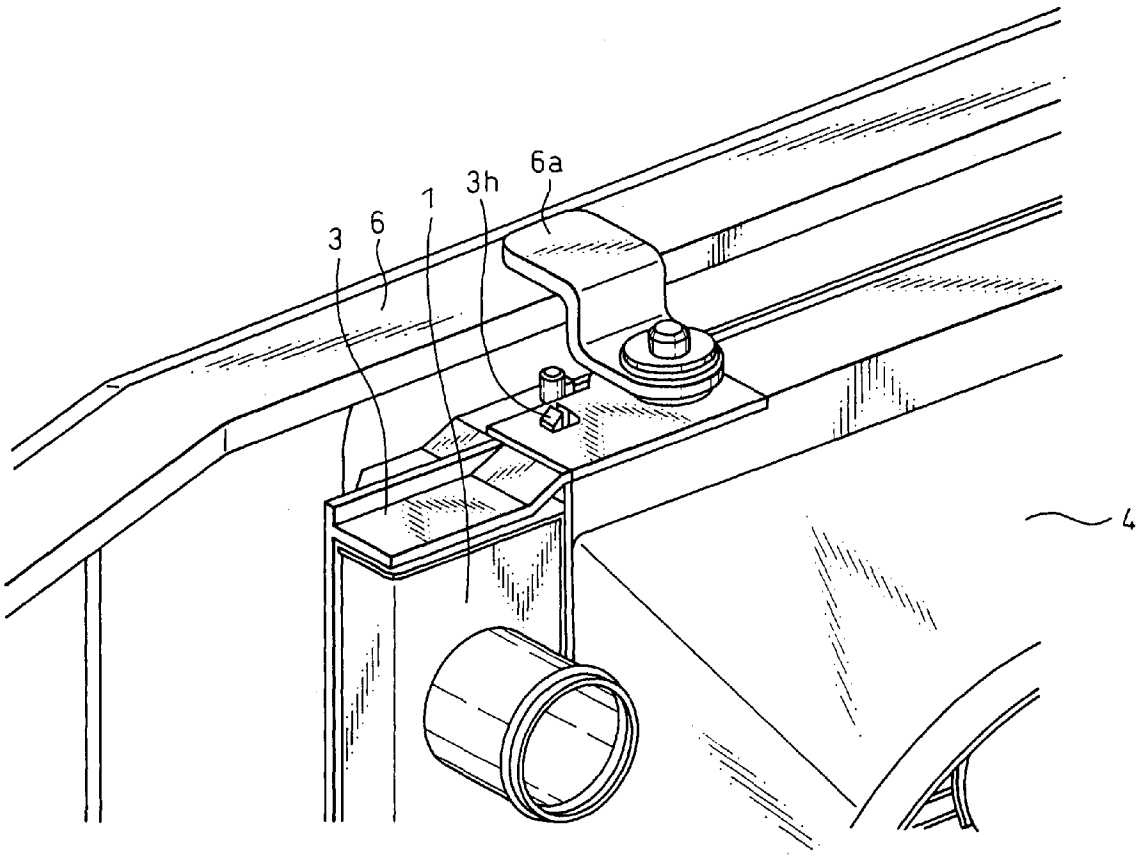
FIG. 11 is an explanatory view of the assembly of the cooling module according to the first embodiment of the present invention.

The top end side of a fan shroud 4 is prevented from moving with respect to the brackets 3 in the horizontal direction by inserting the mounting pins 3*b* into holes 4*a* (refer to FIG. 9 and FIG. 10) formed in the fan shroud 4, as shown in FIG. 7 and FIG. 8 and, at the same time, it is pressed by an upper member or a radiator support 6 which is a part of the vehicle body, as shown in FIG. 11, and the movement of the fan shroud 4 in the vertical direction is prevented.

In the present embodiment, in addition to the radiator support 6 that presses the fan shroud 4, the brackets 3 are provided with snap fits 3*h* that engage with the fan shroud 4 and fix the brackets 3 and the fan shroud 4 and, in addition to the case where the cooling module has been assembled to a vehicle, the fan shroud 4 is prevented from shifting from the proper position with respect to the brackets 3 in the case where the cooling module is not yet assembled to a vehicle, for example, while it is being transported.

Figure 9:
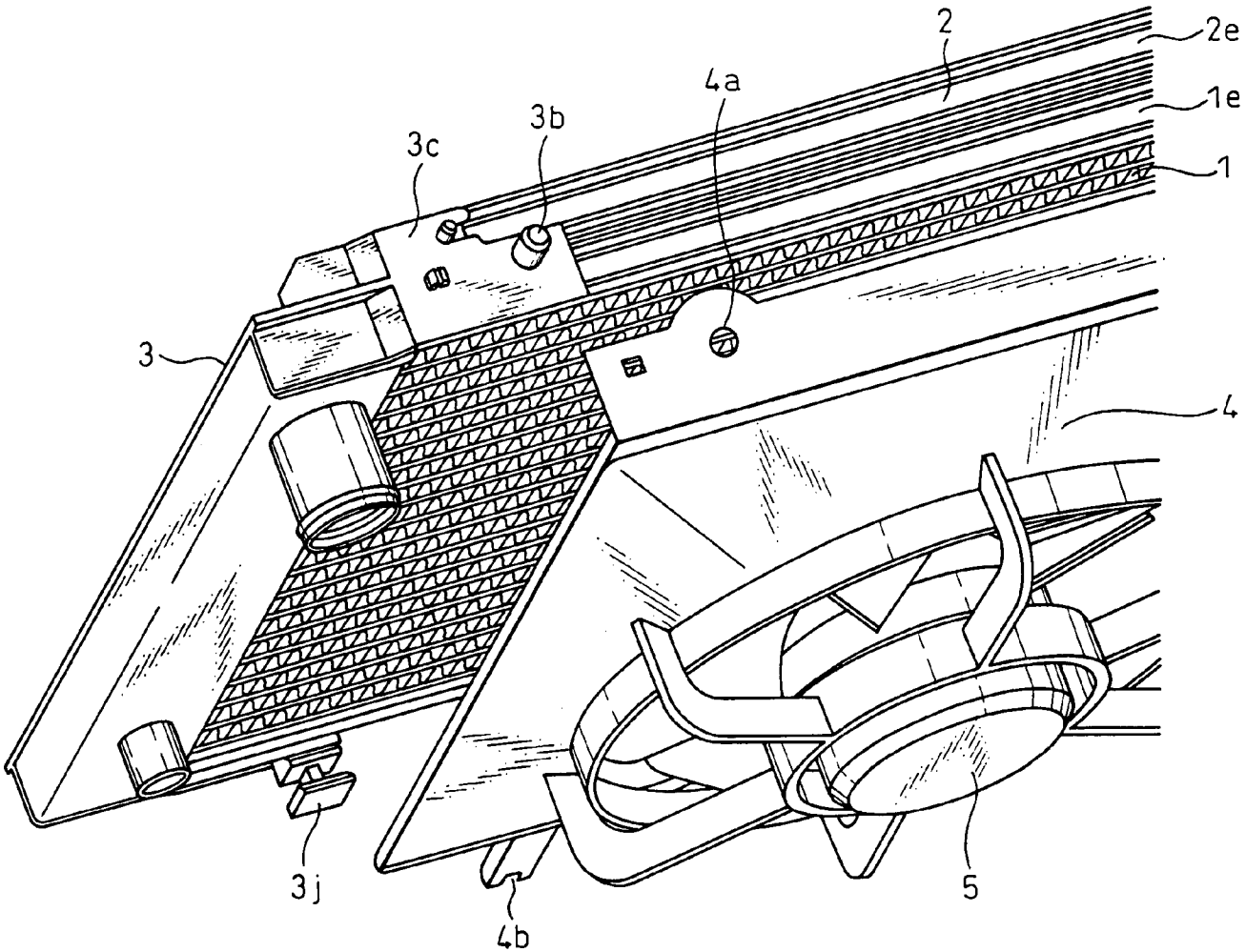
FIG. 9 is an explanatory view of the assembly of the cooling module according to the first embodiment of the present invention.

On the other hand, the top end side of the fan shroud 4 is supported by support projections 3*j* provided to the brackets 3, as shown in FIG. 9 and FIG. 10. The support projection 3*j* has an umbrella-shaped flange at the front end side and the fan shroud 4 is prevented from moving downward and in the horizontal direction by inserting the support projections 3*j* into recess-shaped slots 4*b* (refer to FIG. 9) provided in the fan shroud 4.

The object of the fan shroud 4 is to support an air blower 5 (refer to FIG. 9) that sends a current of cooling air to a heat exchanger such as the radiator 1 and, in the present embodiment, it has, in addition to the function as a support member, a function to prevent a current of air produced by the air blower 5 from flowing so as to skirt the air blower 5 and the radiator 1 by covering the gap between the air blower 5 and the radiator 1.

Next, the procedure of assembling the cooling module is described below.

First the condenser 2 and the brackets 3 are assembled in such a way that the brackets 3 are inserted into the condenser 2 (refer to FIG. 4), and then the radiator 1 is assembled to the brackets 3 (refer to FIG. 5).

Next, the fan shroud 4 is assembled to the cooling module from above in such a way that the mounting pins 3*b* are inserted into the holes 4*a* (refer to FIG. 9 and FIG. 10), and, then, the cooling module, to which the fan shroud 4 has been assembled, is assembled to a vehicle (FIG. 11).

The bottom end side of the cooling module is fixed by inserting the mounting pins 3*b* into mounting holes of the vehicle body, and the top end side thereof is fixed in such a way that the top end side is pressed from above by brackets 6*a* of the vehicle body (FIG. 11).

Next, the effects of the present embodiment are described.

In the present embodiment, it is possible to easily assemble the cooling module and the fan shroud 4 because the fan shroud 4 is assembled to the cooling module in such a way that the fan shroud 4 covers the brackets 3 that have been assembled to the cooling module, that is, the radiator 1 and the condenser 2 and, at the same time, the snap fits 3*h* and the vehicle body prevent the fan shroud 4 from being detached from the brackets 3.

Accordingly, it is possible to improve the workability in assembling or disassembling the cooling module and the fan shroud 4.

(Second Embodiment)

Figure 12:
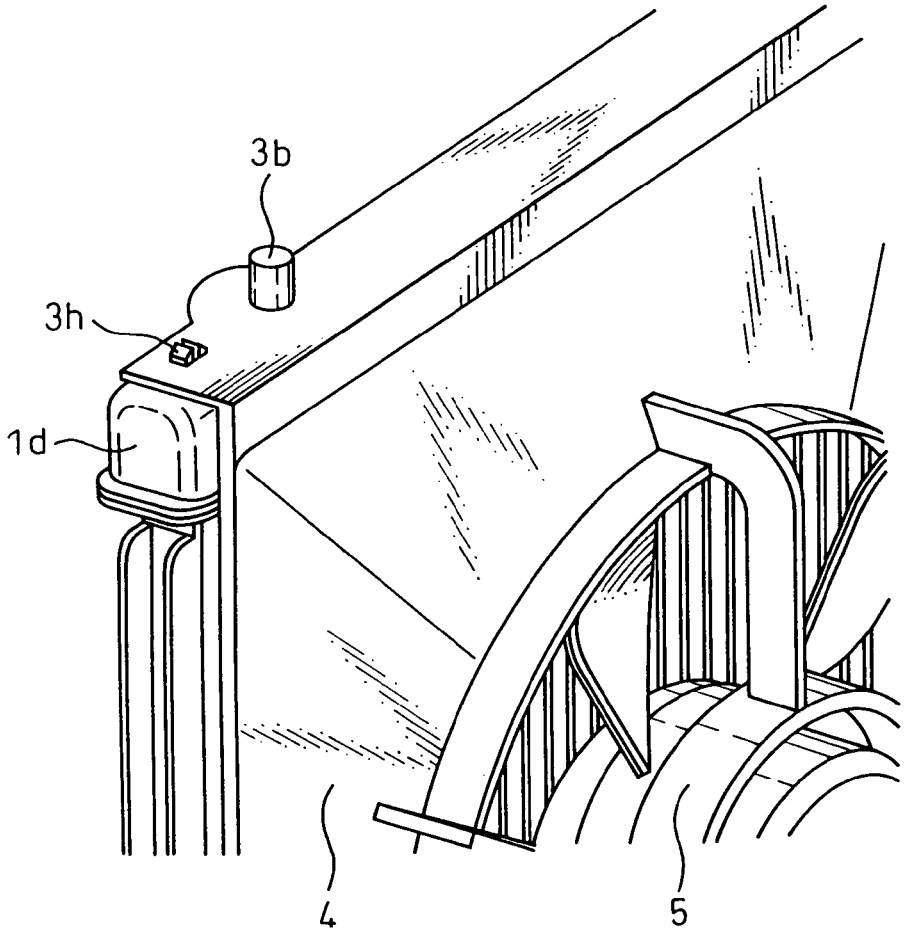
FIG. 12 is a perspective view showing the characteristics of a radiator and a fan shroud according to a second embodiment of the present invention.

Although the vehicle-mounting pins 3*b* are provided to the brackets 3 in the first embodiment, in the present embodiment, the mounting pins 3*b* and the snap fits 3*h* are provided to the header tank 1*d* of the radiator 1 at the upper side thereof and the support projections 3*j* are provided to the header tank 1*d* of the radiator 1 at the lower side thereof, as shown in FIG. 12.

In the present embodiment, the header tank 1*d* is made of resin (for example, nylon containing glass fiber), and the mounting pins 3*b*, the snap fits 3*h*, and the support projections 3*j* are integrally formed to the header tanks 1*d*.

Figure 13:
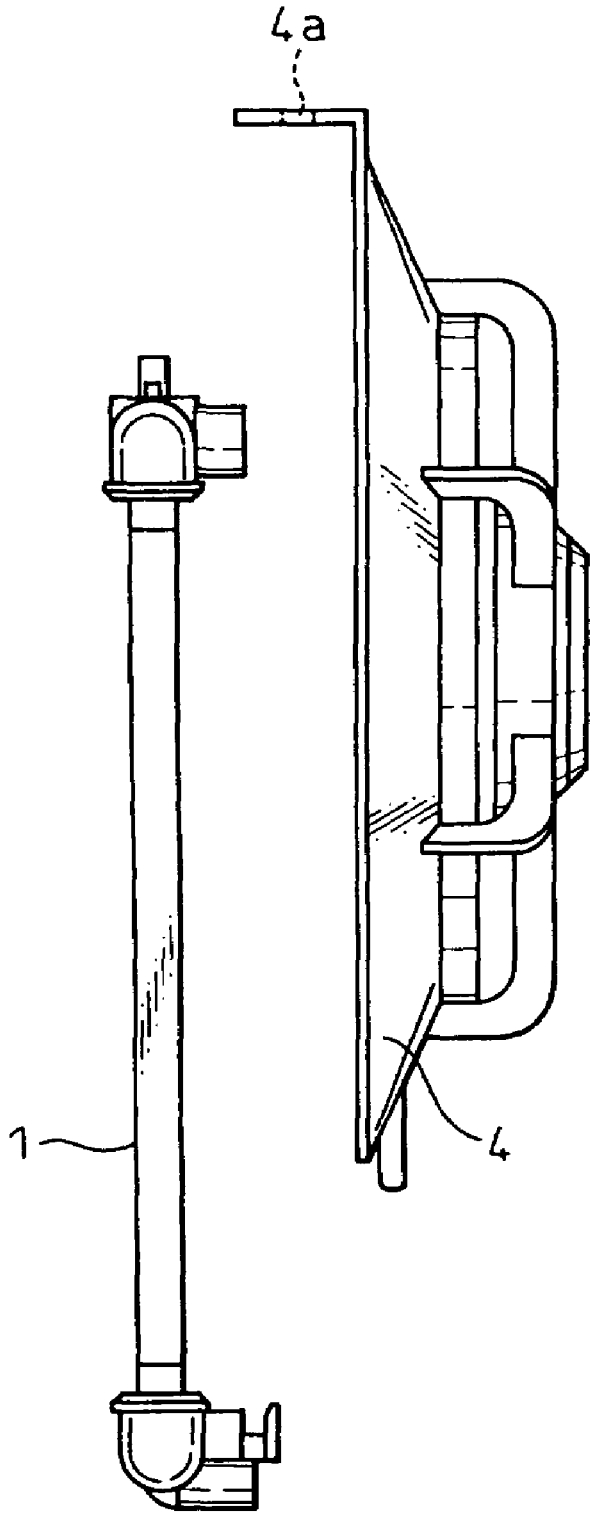
FIG. 13 is an explanatory view of the assembly of the radiator and the fan shroud according to the second embodiment of the present invention.
Figure 14:
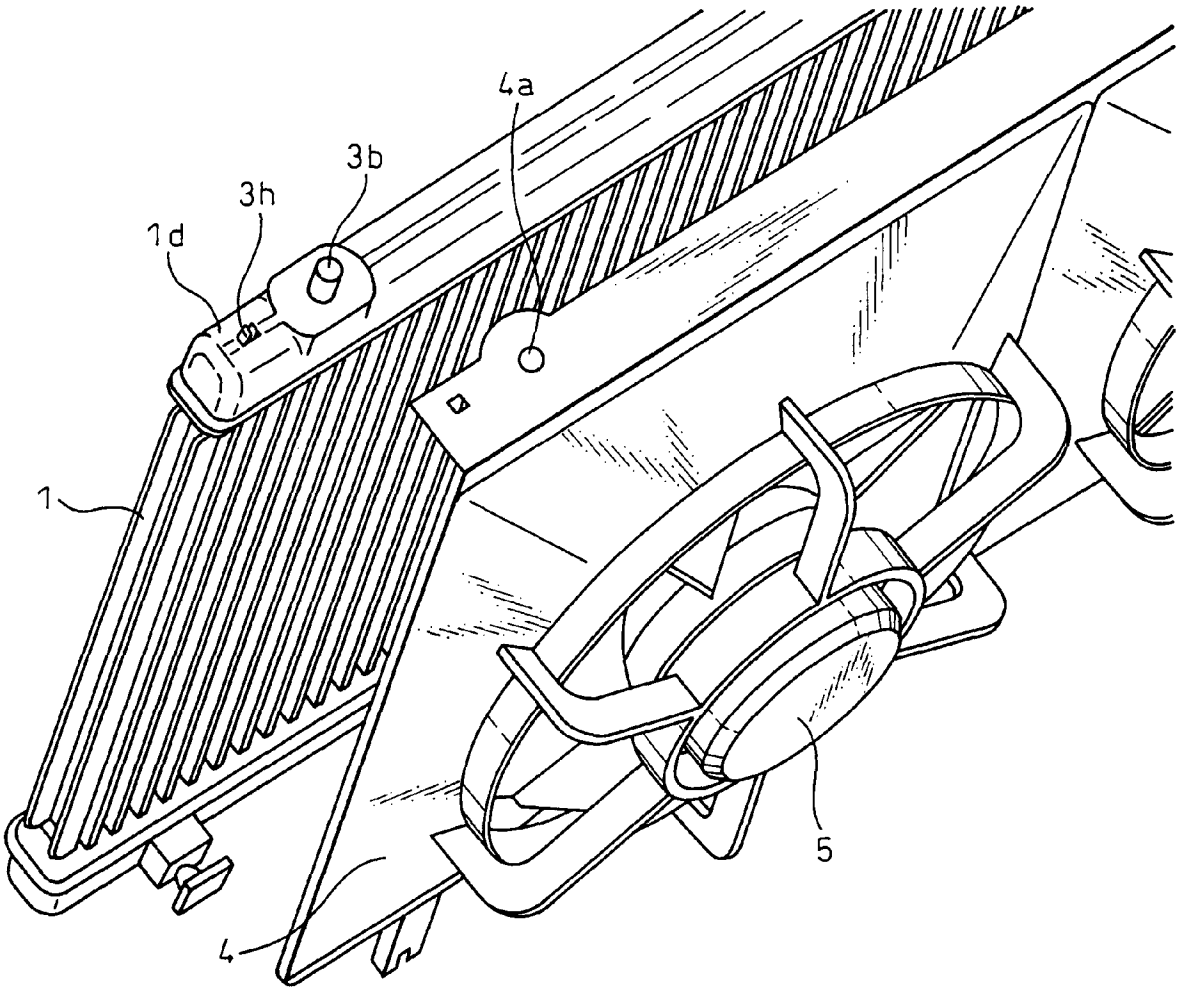
FIG. 14 is an explanatory view of the assembly of the radiator and the fan shroud according to the second embodiment of the present invention.
Figure 15:
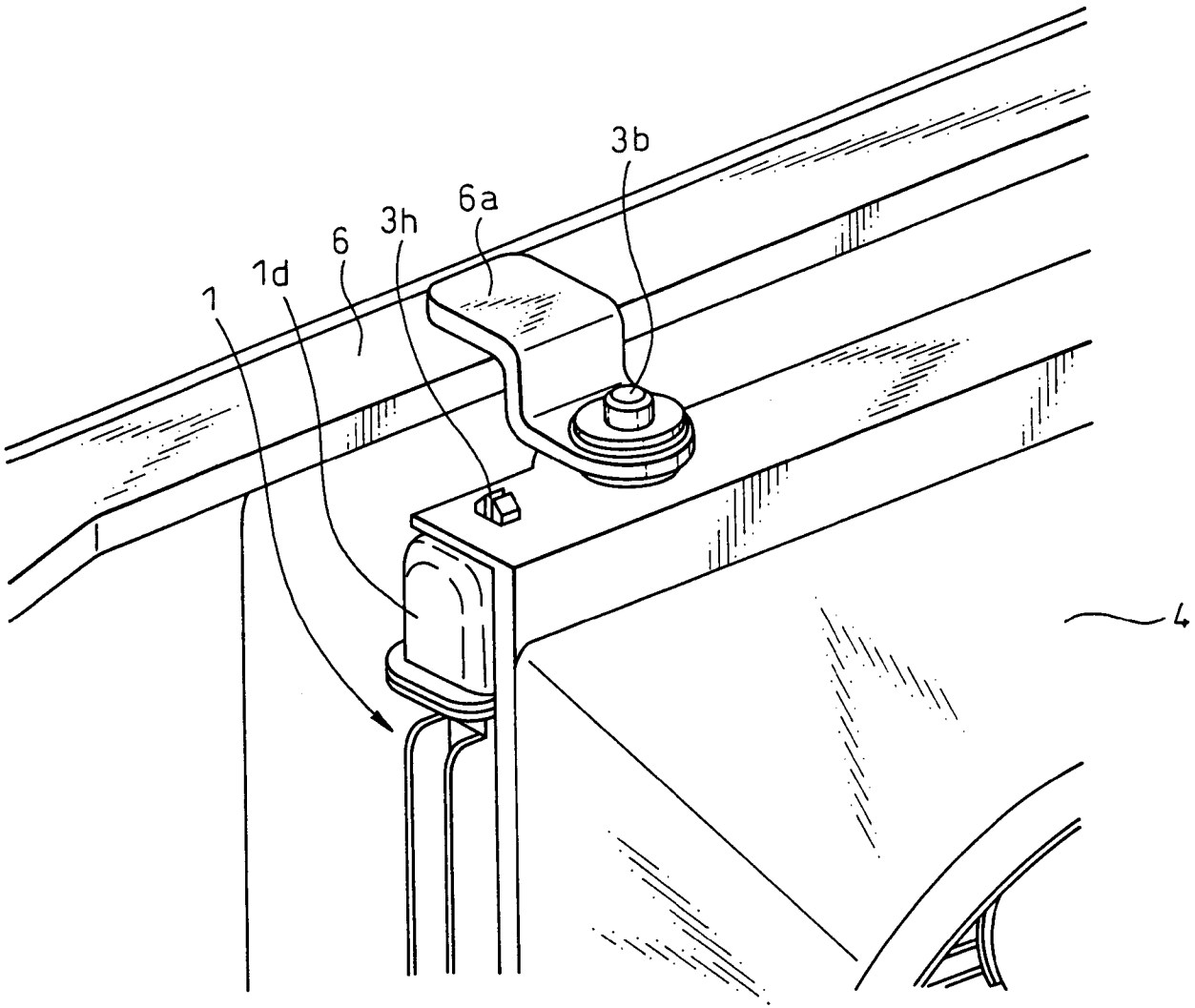
FIG. 15 is an explanatory view of the assembly of the radiator and the fan shroud according to the second embodiment of the present invention.

When assembled to the radiator 1, the fan shroud 4 is assembled to the cooling module from above in such a way that the mounting pins 3*b* are inserted into the holes 4*a* (refer to FIG. 13 and FIG. 14), similar to the first embodiment and, then, the cooling module, to which the fan shroud 4 has been assembled, is assembled to a vehicle body (FIG. 15).

(Other Embodiments)

In the first embodiment, the bracket main body 3*a*, the mounting pins 3*b*, the mounting stays 3*c* and the reinforcing sections 3*d* are integrally formed by resin, but the present invention is not limited to this and, for example, they may be made of metal by a press or by die-casting.

In the first and second embodiments described above, the movement of the fan shroud 4 in the vertical direction is prevented by the snap fits 3*h* and the vehicle body, but the present invention is not limited to this, and the movement of the fan shroud 4 in the vertical direction may be prevented by either the snap fits 3*h* or the vehicle body.

Although in the first embodiment the present invention is applied to a heat exchanger module, into which different kinds of heat exchangers have been integrated by brackets, it is needless to say that the present invention can also be applied to a structure for connecting, for example, only the radiator 1 to the fan shroud 4.

In the second embodiment, the structure is for connecting only the radiator 1 to the fan shroud 4, but it is needless to say that the structure can also be applied to, for example, a heat exchanger module, into which different kinds of heat exchangers have been integrated by brackets.

The snap fits 3*h* are used as tightening-coupling means for preventing the movement in the vertical direction in the embodiments described above but the present invention is not limited to this and, for example, bolts may be used instead.

Although the snap fits 3*h* are provided to the brackets 3 or the radiator 1 in the embodiments described above, on the contrary, tightening-coupling means, such as the snap fits 3*h*, may be provided on the fan shroud 4.

While the invention has been described by reference to specific embodiments chosen for the purposes of illustration, it should be apparent that numerous modifications could be made thereto by those skilled in the art without departing from the basic concept and scope of the invention.

The invention claimed is:

1. A structure adapted to mount a shroud and a heat exchanger to a vehicle body, the structure comprising:

an air blower that creates a current of air;

the shroud that guides the current of air created by the air blower; and brackets adapted to mount the heat exchanger to the vehicle; wherein the brackets and the shroud are adapted to be pressed by part of the vehicle body and prevented from moving in a vertical direction, the shroud being adapted to be sandwiched between the brackets and the vehicle body;

horizontal movement of the shroud with respect to the brackets is prevented by projections that are formed on the top end sides of the brackets and project upward; and a bottom end side of the shroud is supported by support projections provided by the brackets.

2. A structure adapted to mount a shroud a heat exchanger to a vehicle body, the structure comprising:

an air blower that creates a current of air; and the shroud that guides the current of air created by the air blower; wherein the heat exchanger and the shroud are adapted to be pressed by part of a vehicle body and prevented from moving in a vertical direction, the shroud being adapted to be sandwiched between the heat exchanger and the vehicle body;

horizontal movement of the shroud with respect to the heat exchanger is prevented by projections that are formed on the top end side of the heat exchanger and project in the vertical direction; and a bottom end side of the shroud is supported by support projections provided by the heat exchanger.

3. A structure connecting a shroud to a heat exchanger, the structure comprising:

an air blower that creates a current of air;

the shroud that guides the current of air created by the air blower; and brackets adapted to mount the heat exchanger to a vehicle body, the brackets covering a top side and a bottom side of the heat exchanger; wherein the shroud is prevented from moving in a vertical direction by tightening-coupling means provided on one of the brackets and the shroud;

horizontal movement of the shroud with respect to the brackets is prevented by projections that are formed on top end sides of the brackets and project upward; and a bottom end side of the shroud is supported by support projections provided by the brackets.

4. A structure connecting a shroud to a heat exchanger, the structure comprising:

an air blower that creates a current of air; and the shroud that guides the current of air created by the air blower, the shroud covering a top side of the heat exchanger; wherein;

the shroud is prevented from moving in a vertical direction by tightening-coupling means provided on the heat exchanger;

horizontal movement of the shroud with respect to the heat exchanger is prevented by projections that are formed on a top end side of the heat exchanger and project in the vertical direction; and the bottom end side of the shroud is supported by support projections provided by the heat exchanger.

5. A structure, as set forth in claim 3, wherein the tightening-coupling means are engaging-stopping projections that can displace elastically.

6. A structure, as set forth in claim 1, wherein the brackets are provided with the projections and the shroud is provided with insertion holes into which the projections are inserted.

7. A structure, as set forth in claim 1, wherein plural heat exchangers are assembled to the brackets so as to sandwich the brackets.

8. A structure, as set forth in claim 1, wherein the shroud has a substantially L-shaped section which comprises:

a top end portion that is assembled to the projections of the brackets; and an air guide portion that supports the air blower and guides the current of air created by the air blower.

9. A structure, as set forth in claim 4, wherein the tightening-coupling means have engaging-stopping projections that can displace elastically.

10. A structure, as set forth in claim 3, wherein the shroud is provided with insertion holes into which the projections are inserted.

11. A structure, as set forth in claim 3, wherein plural heat exchangers are assembled to the brackets so as to sandwich the brackets.

12. A structure, as set forth in claim 2, wherein the shroud has a substantially L-shaped section which comprises:

a top end portion that is assembled to the projections of the heat exchanger; and an air guide portion that supports the air blower and guides the current of air created by the air blower.

13. A structure, as set forth in claim 3, wherein the shroud has a substantially L-shaped section which comprises:

a top end portion that is assembled to the projections of the brackets; and an air guide portion that supports the air blower and guides the current of air created by the air blower.

14. A structure, as set forth in claim 4, wherein the shroud has a substantially L-shaped section which comprises:

a top end portion that is assembled to the projections of the heat exchanger; and an air guide portion that supports the air blower and guides the current of air created by the air blower.

15. A structure as set forth in claim 1, wherein the projections that are formed on the top end sides of the brackets are adapted to engage the vehicle body.

16. A structure as set forth in claim 2, wherein the projections that are formed on the heat exchanger are adapted to engage the vehicle body.

17. A structure as set forth in claim 3, wherein the projections that are formed on the top end sides of the brackets are adapted to engage the vehicle body.

18. A structure as set forth in claim 4, wherein the projections that are formed on the heat exchanger are adapted to engage the vehicle body.

* * * * *